United States Patent [19]

Bruno

[11] 4,327,874

[45] May 4, 1982

[54] SPRING LOADED CORE ADAPTOR

[75] Inventor: Gerald R. Bruno, Paterson, N.J.

[73] Assignee: Progressive Machine Company, Inc., Paterson, N.J.

[21] Appl. No.: 211,209

[22] Filed: Nov. 28, 1980

[51] Int. Cl.[3] ..... B65H 54/54

[52] U.S. Cl. ..... 242/46.2; 242/46.3; 242/46.6; 242/68.4; 242/129.51

[58] Field of Search ..... 242/46.2, 46.21, 46.3, 242/46.4, 46.6, 68, 68.1, 68.2, 68.3, 68.4, 129.5, 129.51, 129.6, 129.7, 129.71, 130.1

[56] References Cited

U.S. PATENT DOCUMENTS

| | | | |
|---|---|---|---|
| 676,335 | 6/1901 | Moffatt | 242/46.3 |
| 775,850 | 11/1904 | Norcross | 242/46.4 |
| 2,156,089 | 4/1939 | Hinnekens | 242/68.2 |
| 2,436,326 | 2/1948 | Pierce | 242/46.6 X |
| 2,625,336 | 1/1953 | Brouillard | 242/46.6 |
| 2,639,576 | 5/1953 | Bay | 242/46.6 X |
| 2,713,462 | 7/1955 | Camras | 242/68.3 |
| 2,956,757 | 10/1960 | Limbach | 242/46.3 |
| 3,038,679 | 6/1962 | Pospiszel | 242/68.2 |
| 3,043,530 | 7/1962 | Healy | 242/43.1 |
| 3,445,076 | 5/1969 | Dalglish | 242/68.2 |

FOREIGN PATENT DOCUMENTS

| | | | |
|---|---|---|---|
| 211728 | 2/1924 | United Kingdom | 242/46.4 |

OTHER PUBLICATIONS

Matthaei, H., Self-Locking Support For Ribbon Spool, IBM Technical Disclosure Bulletin, vol. 20, No. 8, Jan. 1978, pp. 3177–3178.

*Primary Examiner*—Stanley N. Gilreath

*Attorney, Agent, or Firm*—Lerner, David, Littenberg & Samuel

[57] ABSTRACT

A spring loaded core adaptor is disclosed, including a hub of circular cross section for releasable engagement with the internal surface of one end of a hollow tubular core. The engagement permits rotation of the core in a preferred direction about its longitudinal axis for winding continuous material under tension on the outer surface of the core. The hub disclosed includes one or more arched spring clips secured within grooves arranged along the external surface of the hub. The spring clips engage a portion of the internal surface of the core to prevent relative rotation between the core and the hub in response to the rotation of the hub in the preferred direction; and, to releasably engage a portion of the internal surface of the core to permit relative rotation therebetween in response to the rotation of the hub in the opposite direction.

12 Claims, 4 Drawing Figures

SPRING LOADED CORE ADAPTOR

FIELD OF THE INVENTION

The present invention relates in general to a core adaptor for rotating a core about its longitudinal axis, and more particularly, to a spring loaded core adaptor constructed and arranged for preventing or permitting relative rotation between the core and the adaptor depending upon the direction of rotation of the adaptor.

BACKGROUND OF THE INVENTION

Various materials such as rope, string, ribbon, paper, cloth and the like, are supplied in continuous form by being wound under tension about a hollow tubular member generally referred to as a core. The material is wound on the outer surface of the core by rotating the core about its longitudinal axis using a winding apparatus such as that disclosed in U.S. Pat. No. 3,043,530. Rotation of the core is brought about by using a core adaptor positioned within one end of the core. The adaptor is constructed to engage the internal surface of the core to impart rotational movement in response to the rotation of the adaptor. As the material is being wound under tension, it is required to prevent relative rotation between the core and the adaptor to permit the continuous and smooth winding of the material.

One prior art adaptor which prevents relative rotation between the core and adaptor is disclosed in the above-noted patent. According to such prior art, the adaptor is constructed from a hub of generally circular cross section. The core is removably secured around the periphery of the hub by a series of spring clips secured within grooves formed along the outer surface of the hub. The clips extend sufficiently outward beyond the outer surface of the hub to engage a portion of the internal surface of the core and to bias the core in place during the winding operation. As the adaptor is axially rotated, the clips engage the internal surface of the core to prevent relative rotation between the core and the hub.

The clips of the prior art are constructed and arranged within the grooves to engage the internal surface of the core when the adaptor is rotated in either the clockwise or counterclockwise direction preventing relative rotation between the core and the hub. As a result, it becomes relatively difficult to remove the core from the hub of the adaptor upon completion of the winding operation. To remove the core from the hub, the operator of the winding apparatus often grips the core about the wound material and pulls the core in a longitudinal direction while trying to twist the core about the hub. When all but the strongest material has been wound, the use of a prior art adaptor can result in damage to the material when attempting to free the core. Accordingly, there is a need for a spring loaded core adaptor which is constructed and arranged for quick and easy installation within a core and for its subsequent quick and easy removal, in particular, in a manner which effectively eliminates the possibility of damage to the wound material.

It is broadly an object of the present invention to provide an adaptor which avoids one or more of the foregoing disadvantages inherent in the use of the prior art adaptors. Specifically, it is within the contemplation of the present invention to provide a spring loaded core adaptor which is constructed and arranged to prevent relative rotation between the core and the hub of the adaptor in response to the rotation of the hub in the direction of the winding operation while at the same time permitting relative rotation therebetween in response to the rotation of the hub in the opposite direction.

A further object of the present invention is to provide an adaptor which permits the smooth and continuous axial rotation of a core while winding material under tension over the outer surface of the core.

A still further object of the present invention is to provide an adaptor which can be quickly and easily installed within one end of a core and which can be quickly and easily removed.

Yet still a further object of the present invention is to provide a spring loaded core adaptor which is constructed and arranged to engage the internal surface of a core when being rotated in one direction about its axis and for permitting release of the core from the hub of the adaptor when being rotated in the opposite direction.

SUMMARY OF THE INVENTION

In accordance with one embodiment of the present invention, there is provided a hub for releasable engagement with the internal surface of one end of a hollow core for permitting rotation of the core in only one direction about its axis. The hub includes at least one groove arranged along the external surface of the hub and bias means within the groove. The bias means include a first portion arranged for engaging the internal surface of the core for preventing relative rotation between the core and the hub in response to the rotation of the hub in a first direction. The bias means further include a second portion arranged for releasably engaging the internal surface of the core for permitting relative rotation between the core and the hub in response to the rotation of the hub in a second direction.

Further in accordance with the above embodiment, the hub includes a lip at one end for restricting the extent of engagement of the hub with the internal surface of one end of the core.

BRIEF DESCRIPTION OF THE DRAWINGS

The above description, as well as further objects, features and advantages of the present invention will be more fully understood by reference to the following detailed description of the presently preferred, but nonetheless illustrative spring loaded core adaptor in accordance with the present invention when taken in conjunction with the accompanying drawings, wherein.

DETAILED DESCRIPTION

Figure 1:
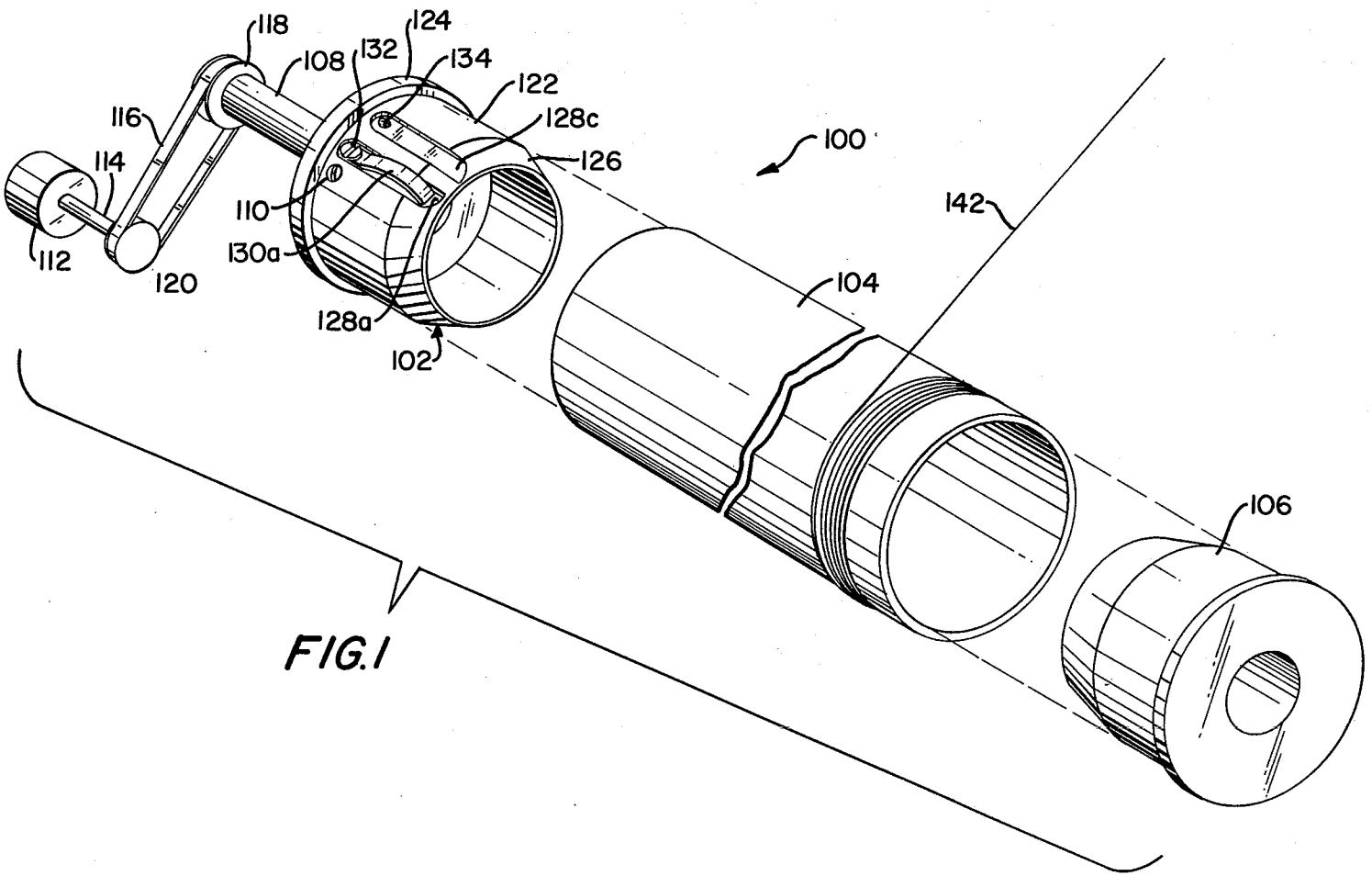
FIG. 1 is a perspective view of a continuous material winding assembly including a spring loaded core adaptor mounted to a shaft for rotational movement, a core for winding continuous material over its outer surface in response to the rotation of the spring loaded core adaptor, and a second adaptor for maintaining axial alignment of the core during the winding operation.

There will now be described according to one embodiment of the present invention, a spring loaded core adaptor including a hub having spring clips arranged within grooves for releasable engagement with the internal surface of one end of a hollow core and permitting rotation of the core in a desired direction about its axis. Referring specifically to FIG. 1, there is shown a winding assembly indicated generally by element number 100. The assembly 100 includes a spring loaded core adaptor 102, a hollow tubular core 104 and a second core adaptor 106 which is generally constructed without spring clips. The adaptor 102 is connected to one end of a drive shaft 108 by an adjustable set screw 110 engaged within a threaded opening extending through a side portion of the adaptor.

In one embodiment, the adaptor 102 is indirectly axially rotated by a motor 112 having a drive shaft 114. The torque of the motor 112 is imparted to the adaptor 102 by belt 116 engaged within the grooves of pulleys 118, 120 which are respectively secured to the ends of drive shafts 108, 114. Although motor 112, pulleys 118, 120 and belt 116 has been described for rotating the adaptor 102, other mechanical devices such as gears, clutches and the like are contemplated for causing rotation of the adaptor of the present invention.

The construction of the adaptor 102, in accordance with the preferred embodiment of the present invention, will now be described generally with reference to FIGS. 1 through 3. Referring specifically to FIG. 1, the adaptor 102 is constructed from a cylindrical hub 122 having a protruding lip 124 circumscribing one end and a tapered portion 126 at the other end extending between the internal and external surfaces of the hub. Grooves and spring clips are circumferentially arranged along the external surface of the hub 122 in generally axial alignment with the longitudinal axis of the hub. As shown in FIG. 3, clips 130*a*, 130*b* are secured within selected grooves 128*a*, 128*b* by retaining screws 132 which engage threaded openings 134 within hub 122.

Figure 2:
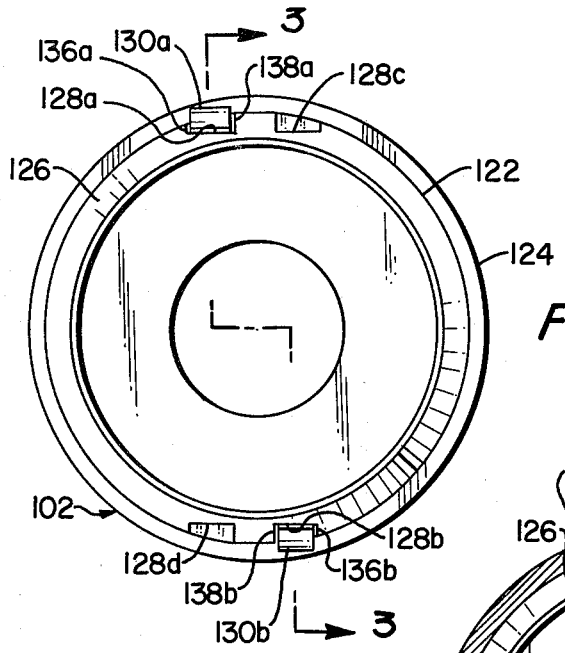
FIG. 2 is a side elevation of the spring loaded core adaptor as illustrated in FIG. 1 showing spring clips arranged within grooves along the external surface of the hub of the adaptor.
Figure 3:
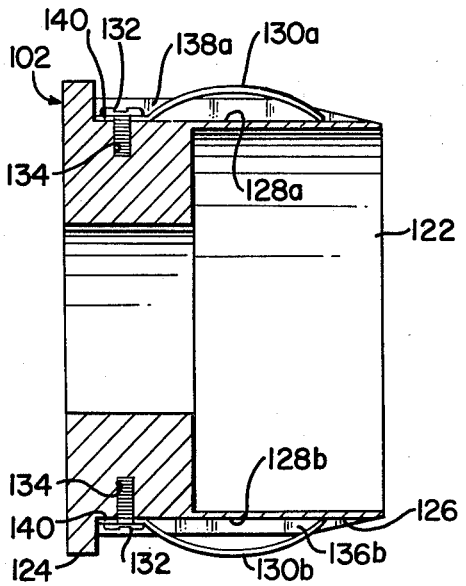
FIG. 3 is a cross-sectional elevation taken along lines 3—3 of FIG. 2 showing the spring clips secured within grooves arranged in axial alignment with the adaptor along the external surface of the hub.

Referring to FIGS. 2 and 3, the construction and arrangement of grooves 128*a*, 128*b* and clips 130*a*, 130*b* will now be described. In the embodiment illustrated, grooves 128*a*, 128*b* and clips 130*a*, 130*b* permit rotation of core 104 in response to the rotation of hub 122 in a counterclockwise direction; and, permit release of the core from the hub in response to the rotation of the hub in a clockwise direction. Grooves 128*a*, 128*b* are symetrically arranged around the circumference of hub 122. The bottom surface of grooves 128*a*, 128*b* are arranged to provide the grooves with narrow confining side walls 136*a*, 136*b* and opposed wide confining side walls 138*a*, 138*b*.

Clips 130*a*, 130*b* are constructed to form an arched body having side edges and a tab 140 at one end to secure the clips to the bottom surface of grooves 128*a*, 128*b* by retaining screws 132. Clips 130*a*, 130*b* can be constructed from resilient spring steel or other such suitable materials. The side edges proximate to the narrow confining side walls 136*a*, 136*b* protrude sufficiently beyond the external surface of hub 122 to engage a portion of the internal surface of core 104 to prevent relative rotation between the core and the hub in response to the rotation of the hub in a counterclockwise direction, as to be described hereinafter. The opposed side edges proximate to the wide confining side walls 138*a*, 138*b* are adjacent to the external surface of hub 122 to releasably engage the internal surface of core 104 to permit relative rotation between the core and the hub in response to the rotation of the hub in a clockwise direction.

The number of clips which are required to be provided within grooves is dependent upon the power that must be transmitted from adaptor 102 to core 104 during the winding operation. Generally, hub 122 is constructed to include a plurality of grooves arranged symetrically about the circumference of the hub. Clips are secured only within the required number of grooves to effectively transmit the required power to smoothly and continuously rotate the core 104 while winding material under tension. The remaining grooves will accordingly be left empty without a clip.

Further in accordance with the preferred embodiment, corresponding grooves 128*c*, 128*d* are provided to include clips (not shown) secured therein to prevent relative rotation between core 104 and hub 122 in response to the rotation of the hub in a clockwise direction; and, to permit relative rotation between core 104 and hub 122 in response to the rotation of the hub in a counterclockwise direction. Grooves 128*c*, 128*d* and clips (not shown) are constructed and arranged incorporating the principles of the present invention as previously described with reference to grooves 128*a*, 128*b* and clips 130*a*, 130*b*.

Adaptor 102 can be provided with a plurality of grooves having clips secured within selected grooves to permit rotation of core 104 in the desired direction and to permit removal of the core from hub 122 by rotation in the opposite direction. Accordingly, only a single adaptor 102 need be supplied for rotating core 104 in either direction for transferring the required power from the adaptor to the core.

The operation of the adaptor 102 for continuously winding material under tension about core 104 will now be described with reference to FIGS. 1 and 4. Core 104, upon which continuous material 142 is to be wound under tension, can be constructed from a variety of materials such as aluminum, brass, plastic, wood, cardboard and the like. One end of core 104 is initially aligned with tapered portion 126 of adaptor 102. Tapered portion 126 facilitates the insertion of hub 122 within the end of core 104. The external surface of hub 122 releasably engages with the internal surface of core 104 as the core is slid over the hub until the end of the core abuts against protruding lip 124. Lip 124 is effective to restrict the extent of engagement of hub 122 with the end of core 104.

Figure 4:
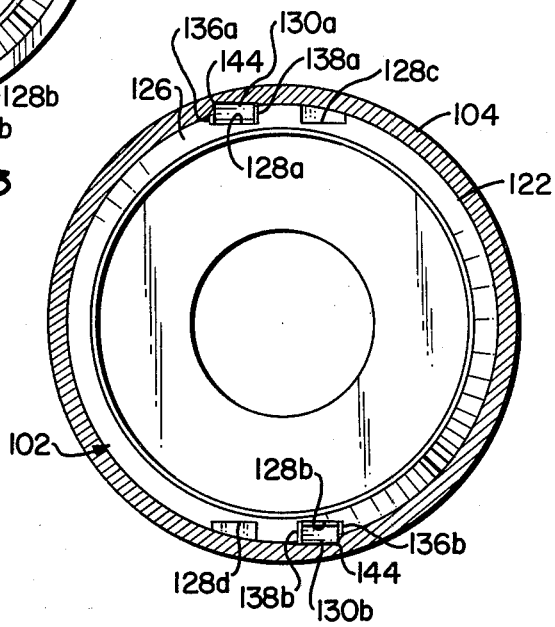
FIG. 4 is a side elevation of the spring loaded core adaptor illustrated in FIG. 2, shown in engagement with the internal surface of a core for permitting rotation in a counterclockwise direction.

As core 104 is slid over hub 122, clips 130*a*, 130*b* are depressed downward toward the bottom surface of grooves 128*a*, 128*b* as illustrated in FIG. 4. The edges of clips 130*a*, 130*b*, proximate the wide confining side walls 138*a*, 138*b*, are now arranged adjacent the external surface of hub 122 thereby avoiding engagement with the internal surface of core 104 to permit relative rotation between the core and the hub. The opposite edges of clips 130*a*, 130*b*, proximate the narrow confining side walls 136*a*, 136*b*, remain sufficiently protruding beyond the external surface of hub 122 to engage a portion of the internal surface of core 104 at locations 144 to prevent relative rotation between the core and the hub.

In operation of winding assembly 100, as the adaptor 102 is rotated in a counterclockwise direction by motor 112, the protruding edges of clips 130*a*, 130*b*, sufficiently engage the internal surface of core 104 at locations 144 to prevent relative rotation between the core and hub 122. This engagement causes core 104 to smoothly and continuously rotate about its axis for winding material 142 under tension upon its outer surface. As the torque applied to adaptor 102 from motor 112 is increased, such as when the applied tension increases, clips 130*a*, 130*b* further engage the internal surface of core 104 to transfer the required increased power from motor 112 to drive the core during the winding operation. At the end of the winding operation, core 104 is removed from hub 122 of adaptor 102 by rotating either the core or adaptor in the clockwise direction. Clips 130*a*, 130*b* having their opposed edges proximate to the wide confining side walls 138*a*, 138*b* and substantially flush with the external surface of hub 122, permit relative rotation between core 104 and the hub to facilitate removal of the core. Once core 104 is removed from its engaged position with clips 130*a*, 130*b*, clips return to their initial position due to their resilient construction from material such as spring steel and the like.

Accordingly, the spring loaded core adaptor of the present invention, can be quickly and easily installed within one end of a hollow core and subsequently can be quickly and easily removed from the core without the potential of causing damage to the wound material. Although the invention herein has been described with reference to particular embodiments, it is to be understood that these embodiments are merely illustrative of the principles and application of the present invention. Thus, it is to be understood that numerous modifications may be made in the illustrative embodiments and other arrangements may be devised without departing from the spirit and scope of the present invention as defined by the appended claims.

What is claimed is:

1. An adaptor for releasable engagement with the internal surface of one end of a hollow core and permitting rotation of said core about the longitudinal axis of said hub in one direction for winding material upon said core, said adaptor comprising a hub including at least one groove having a bottom surface formed within the external surface of said hub and arranged in axial alignment therewith, and a spring member having first and second spaced edges provided within said groove and adapted to be deflected towards said bottom surface of said groove, said groove constructed and arranged to receive said spring member therein such that upon deflection of said spring member towards said bottom surface of said groove at least a portion of said first edge remains sufficiently protruding beyond the external surface of said hub to engage a portion of the internal surface of said core to prevent relative rotation between said core and said hub in response to the rotation of said hub about its axis in one direction while said second edge being sufficiently adjacent to the external surface of said hub to releasably engage the internal surface of said core to permit relative rotation between said core and said hub in response to rotation of said hub in a direction opposite said one direction.

2. The adaptor as set forth in claim 1 wherein said bottom surface of said groove is arranged to extend transversely from a location adjacent to said external surface to a location remote from said external surface.

3. The adaptor as set forth in claim 1 wherein said spring member is constructed of an arched body removably secured to said bottom surface.

4. The adapter as set forth in claim 2 wherein said first and second spaced edges of said spring member are adapted to be deflected toward said bottom surface of said groove upon engagement by said spring member with the internal surface of one end of said hollow core.

5. The adaptor as set forth in claim 1 further including a plurality of said grooves arranged within the external surface of said hub and arranged in axial alignment therewith.

6. The adaptor as set forth in claim 5 wherein said plurality of grooves are symetrically arranged about said hub.

7. The adaptor as set forth in claim 1 wherein said one direction is clockwise and said opposite direction is counter-clockwise.

8. The adaptor as set forth in claim 1 wherein said one direction is counter-clockwise and said opposite direction is clockwise.

9. An adaptor for releasable engagement with the internal surface of one end of a hollow core and permitting rotation of said core about the longitudinal axis of said hub in one direction for winding material upon said core, said adaptor comprising a cylindrical hub having at least one groove formed within the external surface of said hub and arranged in axial alignment therewith, said groove having a bottom surface arranged to extend transversely from a first location adjacent to said external surface to a second location remote from said external surface, and a spring member formed of an arched body having first and second spaced edges provided within said groove and adapted to be deflected towards said bottom surface of said groove, said groove adapted to receive said spring member therein such that upon deflection of said spring member towards said bottom surface of said groove at least a portion of said first edge remains sufficiently protruding beyond the external surface of said hub at said first location to engage a portion of the internal surface of said core to prevent relative rotation between said core and said hub in response to rotation of said hub about its axis in one direction while said second edge being sufficiently adjacent to the external surface of said hub at said second location to releasably engage the internal surface of said core to permit relative rotation between said core and said hub in response to the rotation of said hub in a direction opposite said one direction.

10. The adaptor as set forth in claim 9 further including a lip at one end of said hub for restricting the extent of engagement of said hub with the internal surface of said one end of said core.

11. The adaptor as set forth in claim 9 further including means for securing said hub to a rotating means from imparting rotational movement thereto.

12. The adaptor as set forth in claim 9 wherein said spring member is arranged within said groove in axial alignment therewith and having a surface portion provided between said first and second spaced edges adapted for deflection towards said bottom surface of said groove upon engagement with the internal surface of one end of said hollow core.

* * * * *